United States Patent [19]

Mitchell

[11] 4,188,107

[45] Feb. 12, 1980

[54] PHOTOGRAPHIC PRINT PROCESSING SYSTEM

[76] Inventor: Robert W. Mitchell, 707 Myrtle Ave., Saint Joseph, Mich. 49085

[21] Appl. No.: 2,437

[22] Filed: Jan. 10, 1979

[51] Int. Cl.[2] ..... G03D 13/04

[52] U.S. Cl. ..... 354/328; 354/331; 354/344; 206/455; 220/22.3; 220/444

[58] Field of Search ..... 354/312, 315, 331, 335, 354/337, 338, 339, 340, 344; 220/1 B, 444, DIG. 13, 22.3; 206/449, 455

[56] References Cited

U.S. PATENT DOCUMENTS

| | | | |
|---|---|---|---|
| 2,344,710 | 3/1944 | McMurtry | 354/335 |
| 2,458,699 | 1/1949 | Ginsberg | 354/344 |
| 2,526,366 | 10/1950 | Kallio | 354/335 |
| 3,069,002 | 12/1962 | Hart | 206/455 |
| 3,389,824 | 6/1968 | Berchtold | 220/444 |
| 3,768,393 | 10/1973 | Betz et al. | 206/455 |
| 4,147,423 | 4/1979 | Sayre | 354/344 |

FOREIGN PATENT DOCUMENTS

| | | | |
|---|---|---|---|
| 382256 | 12/1907 | France | 354/331 |
| 192598 | 8/1937 | Switzerland | 354/331 |

*Primary Examiner*—L. T. Hix
*Assistant Examiner*—Alan Mathews
*Attorney, Agent, or Firm*—Neuman, Williams, Anderson & Olson

[57] ABSTRACT

A photographic print processing system comprising a processing basket assembly and a tank unit. The basket assembly includes a basket frame structure, a pair of movable top combs, and a plurality of pairs of removable guide members. The basket frame structure comprises front and back members with handles, side combs, bottom combs and base plates. The removable guide members are positioned within the basket and facilitate inserting each of a plurality of exposed photographic sheets of material into the basket with the lights off. As the exposed sheets are placed within the basket, the guide members are withdrawn. Each basket front and back member has a raised guide portion for use in positioning the top combs so that each photographic sheet is secured on all sides within the basket frame. The basket frame further comprises a plurality of spaced apart base plates which induce fluid turbulence and control fluid direction during mild vertical agitation of the basket within the tank. The processing tank unit is shaped to provide maximum stability and comprises a solid form of lightweight material and a shell of plastic fitted over. The tank shell is a unitary structure comprising an outside portion, a funnel shaped top portion and an inner bottom forming a rectangularly shaped cavity.

19 Claims, 11 Drawing Figures

FIG. 8
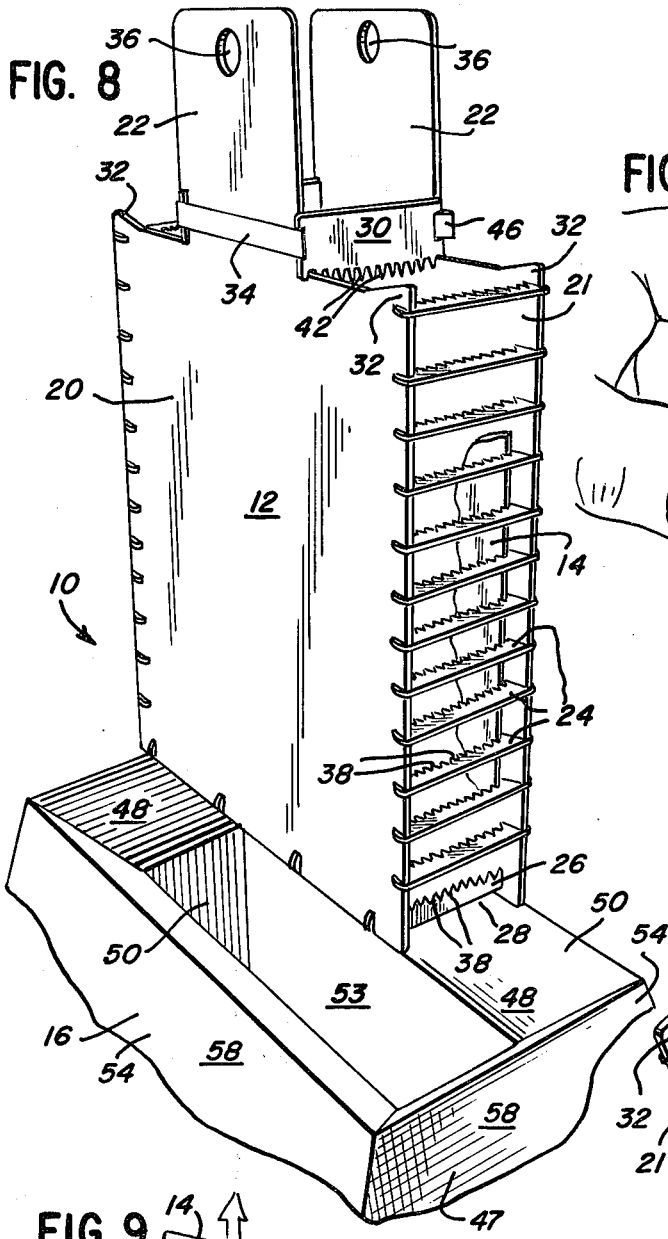
FIG. 4
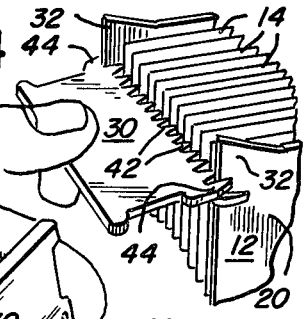
FIG. 5
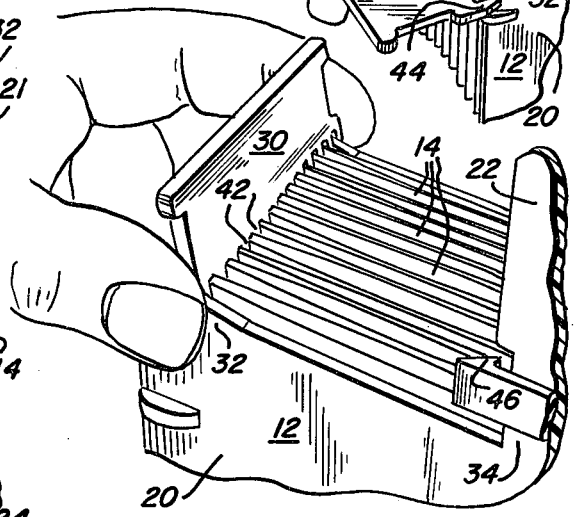
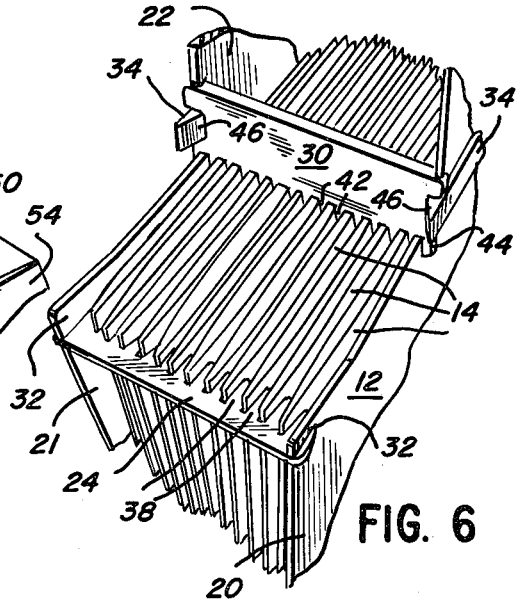
FIG. 6
FIG. 9
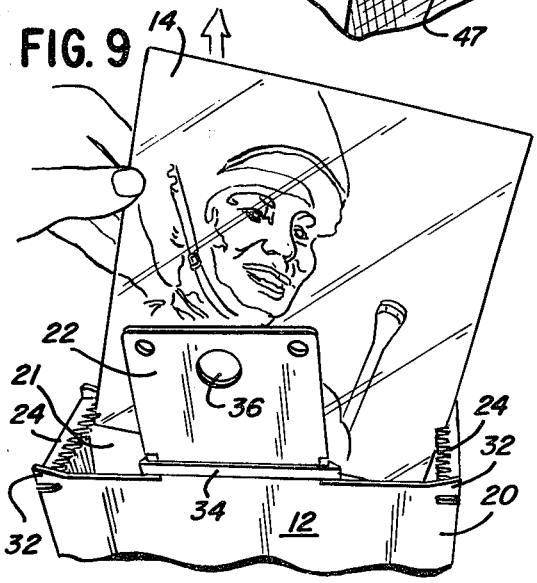
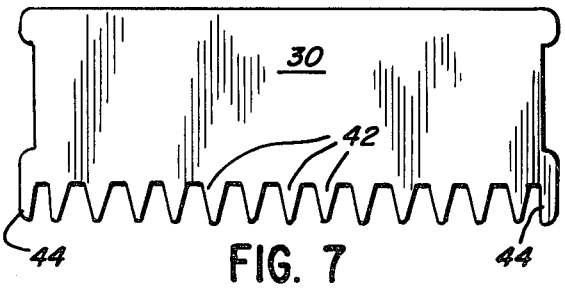
FIG. 7

PHOTOGRAPHIC PRINT PROCESSING SYSTEM

BACKGROUND OF THE INVENTION

This invention relates to a method and apparatus for processing photographic material, and more particularly to a developing basket assembly and tank for processing exposed sheets of photographic material and the method of processing.

From the beginning developments in photography, the actual picture taking has been only an initial step in the involved process leading to the final product, a photographic print. Over the years, many inventions designed to make photographic development better in quality and more efficient have been introduced. Nevertheless, the developing processes remain complex and involved. The advent of color photography has added even more complexity to the developing processes.

The most basic photograph processing is accomplished by the single sheet tray-to-tray method for development. This involves individually dipping a single sheet of exoised photographic material into various trays containing the different developing solutions in accordance with time intervals in the processing sequence. Naturally, this process consumes much of an operator's time and effort and at the end of the long process he produces only one processed print.

Subsequent developments improving the equipment and methods for photographic print processing include the color canoe, drum processors, and basket and tank assemblies. With the color canoe, the operator places a single exposed photographic sheet in the canoe-like structure that floats on water and then pours in the developing fluids. By depressing and releasing one side of the floating canoe, it rocks back and forth in the water thereby sloshing the developing solution over the photographic sheet. The color canoe frees the operator from the constant dipping action which is required by the tray-to-tray method, but is still limited to processing one print at a time. The drum processor further simplifies the photographic print developing processes by introducing an apparatus that permits some of the processing steps to be performed in a lighted room. With a drum processor, the operator inserts an exposed photographic sheet into a cylinder and caps the end while in a dark room. Then with the lights on, the operator pours in the developing fluids through a light-trap opening. The cylinder is then rolled back and forth to slosh the fluid over the sheet. Again, the major disadvantage is that only a single sheet or at most two or three sheets can be developed at one time.

In order to develop a plurality of exposed sheets at once, operators use a complex assembly of devices including print holders and various tanks. One form of holder uses individual frames for each photographic sheet. Each individual exposed sheet is loaded into a separate frame and the loaded frames are then inserted into the holder. The frames of this type of holder tend to inhibit the flow of the processing fluids and complicate the steps necessary for loading the exposed sheets into the holder in a dark room. Other types of holders use only side panels with grooves or other means to hold the edges of the photographic sheets. These holders allow very little of the desirable turbulence which is needed for uniform development. Furthermore, these holders provide no positive separation at the middle section of the photographic sheets. Thus, the prints are often unevenly developed or have imperfections which are caused by the exposed sheets touching each other during the developing process. Still other holders use screened compartments or side panels to separate individual exposed sheets. These types of screened compartments frequently cause shadows of the screen to appear on the developed sheet. All of these types of holders which use one form or another of separating structure for the exposed photographic sheets are difficult to load in the dark.

In addition to the above disadvantages, the holders frequently have perforated sides or bottoms. These perforations allow the developing fluid to contact the exposed photographic sheets. However, the perforations or openings do not direct fluid flow or control the amount of turbulence which is created during processing, thus, the sheets frequently have swirling shadows or uneven development which is caused by over turbulence or erratic fluid flow during processing.

Many forms of processing tanks are used in conjunction with these various holders. Most processing tanks are rectangular structures and are constructed of metal materials, such as stainless steel. These tanks are heavy, but nevertheless, tip over easily when inadvertently jarred. The use of other materials, particularly plastics, for processing tanks has been shunned because these materials tend to bow and weaken from the pressure that the developing fluids exert on the tank walls. Many processing tanks include complex and expensive accessories for maintaining certain temperatures or desired turbulence in the developing solutions. To create the desired turbulence one processing tank uses an expensive and complex means for introducing gas bubbles into the processing tank so that the exposed sheets in the basket are evenly developed. The tanks presently being used are expensive to construct and manufacture.

Some of the above described holders and tanks are now available in the marketplace, the cost of a complete processing system capable of simultaneously processing a plurality of substantially unspoiled prints is prohibitive for the amateur photographer market. Nonetheless, the continuous refinement of print processing holders and tanks demonstrate the desirability of having certain as yet unobtained features in a print processing system. The print holder and tank assembly must be easy to operate in a dark room because an exposed sheet must not be subjected to light during processing. A holder must securely retain and separate the sensitive exposed surfaces of a plurality of sheets to permit the processing solution to engulf and slosh over the sheets during developing to prevent imperfections caused by the sensitive sheet surfaces touching each other. The holder must permit a certain degree of turbulence in the developing fluids and direct the fluids between the plurality of exposed sheets to provide for uniform development of each sheet. Additionally, the processing tank must be durable and sturdy, resistant to tipping over, easy to manufacture, and light-weight.

An object of the present invention is to provide a processing basket with a fluid directional control that creates the desired fluid turbulence when it is mildly agitated within a tank containing the processing fluid.

Another object of the present invention is to provide a processing basket that firmly secures and segregates the sensitive exposed sheet surfaces on all sides by using minimal contact at the sheet edges.

A further object of the present invention is to provide a processing basket which may be easily loaded with a plurality of exposed photographic sheets in a dark room.

Still another object of the present invention is to provide a processing tank for receiving the basket and which is stable and resistant to being tipped over.

A still further object of the present invention is to provide an affordable light-weight basket assembly and processing tank system which is relatively inexpensive to construct, yet sturdy and durable.

Finally, another object of the present invention is to provide a method for processing a plurality of exposed photographic sheets by using a basket assembly and developing tank system.

Other objects and advantages of the invention will become apparent upon reading the following detailed description and appending claims, and upon reference to the accompanying drawings.

SUMMARY OF THE INVENTION

The photographic print processing system of the present invention comprises a basket assembly and a processing tank. The basket assembly comprises front and back members including handles, a plurality of side combs which serve to hold the front and back members of the basket in spaced parallel relationship to each other and secure and segregate flexible sheets of exposed photographic material when disposed therebetween, a plurality of base plates arranged to create the desired turbulence and to direct fluid flow when the basket is mildly agitated within the tank containing processing fluid, a plurality of bottom combs each positioned above a base plate to secure the bottom edge of the photographic sheet material, a pair of movable combs for securing the top of the photographic sheets, and a clip latch for locking the movable top combs in position. Both of the front and back members have raised sloping guide members along which the movable top combs slide. The processing tank comprises a unitary shell having inner and outer walls and a solid form mold filling the volume between the walls. The solid mold prevents the inner walls from bowing under the pressure exerted by the developing fluids. The inner wall has an upper portion shaped like a rectangular funnel which acts as a guide ridge to direct the basket assembly into the tank and a lower portion which defines a rectangularly shaped cavity. The outer walls of the tank have pairs of mutually opposite trapezoidal sides with their longer bases serving to define the base of the tank, thereby providing a wide stable base which provides resistance to inadvertent tipping of the entire tank.

The present invention provides a light-weight and inexpensive basket assembly and tank shell. In the preferred embodiment, both are constructed of light-weight materials, such as plastic which is easily molded. The solid mold form in the preferred embodiment is constructed of a material such as styrofoam and does not add much weight or expense to the tank.

The method of processing exposed photographic sheet material using the basket assembly and tank is a step-by-step process which is easily performed in the dark. To prepare the system in a lighted room, a plurality of pairs of removable guide cards are slidably inserted into the basket so that each pair is separated by the side and bottom combs along the sides and bottom of the basket. In a dark room, the flexible exposed photographic sheets or pairs of sheets back-to-back are disposed between the guide cards of each pair and the guides are then removed leaving only the segregated sheets or pairs of sheets in the basket. The movable top combs are slidably moved along the raised sloping guide members of the front and back portions of the basket to the latch which secures the combs. The sheets are now secure and segregated along all four edges. The loaded basket is then inserted into the tank and mildly agitated vertically in the developing fluid. The base plates of the basket assembly create the degree of fluid turbulence desired and direct fluid flow between the sheets to provide even development of the prints in the basket. After removing the basket from the tank, it is inserted into other tanks containing appropriate solutions to complete the developing process. The sheets are removed from the basket and each individual sheet is allowed to dry. The wet prints are removed from the basket by unlatching and removing the movable top combs and withdrawing the prints from the basket.

Thus, the print processing system of the present invention provides a practical and easy means for processing a single or a plurality of uniformly developed prints at one time. The basket and tank assembly is easy to construct and manufacture because it is constructed of an inexpensive, light-weight material such as plastic which is simple to mold and to assemble. The movable top comb component of the basket in the present invention provides a means to fully secure the exposed photographic sheets within the basket, and also completely segregates the sheets so that the sensitive photo surfaces do not touch each other. The configuration of the basket together with the base plate provide the desired degree of turbulence and directional control in the processing fluids when the basket is mildly agitated within the tank. This turbulence and directional control causes the photographic sheets contained within the basket to remain segregated and to develop uniformly over their entire surface. No shadows, swirl marks, screen marks, or imperfections resulting from touching between adjacent sheets appears on prints which are developed in the basket of the present invention. Additionally, the basket is designed to be efficiently and easily used in a dark room. The tank of the present invention is designed to cooperate with the basket assembly to provide a complete multi-sheet processing system. The tank has a structure which causes it to resist being inadvertently tipped over and prevents the natural tendency for the fluid retaining walls of a tank to bow under the pressure of the fluid contained therein. The tank has a top ridge which functions as an insertion guide for the basket assembly. In addition, both the basket assembly and tank of the present invention may be constructed inexpensively thereby providing an affordable means for the amateur photographer to develop exposed photographic sheets and to have the capability to process just one sheet or a plurality of sheets at one time without sacrificing quality in the print development.

BRIEF DESCRIPTION OF THE DRAWINGS

For a more complete understanding of this invention, reference should now be made of the embodiments illustrated in greater detail in the accompanying drawings and described below. In the drawings:

FIG. 4 is a fragmentary perspective view of the basket showing one of the movable top combs being positioned for guiding along the top of the basket;

FIG. 5 is a fragmentary perspective view of the basket showing the movable top comb guided along the top of the basket and segregating the photographic sheets held therein;

FIG. 6 is a fragmentary perspective view of the basket showing the movable comb in a latched position securing the photographic sheets within the basket;

FIG. 7 is a plan view of one of the movable top combs showing the comb teeth and guide arms;

FIG. 8 is a perspective view of the basket and tank showing the basket entering into the tank;

FIG. 9 is a fragmentary perspective view of the basket showing a developed print being extracted.

DESCRIPTION OF THE PREFERRED EMBODIMENT

Figure 1:
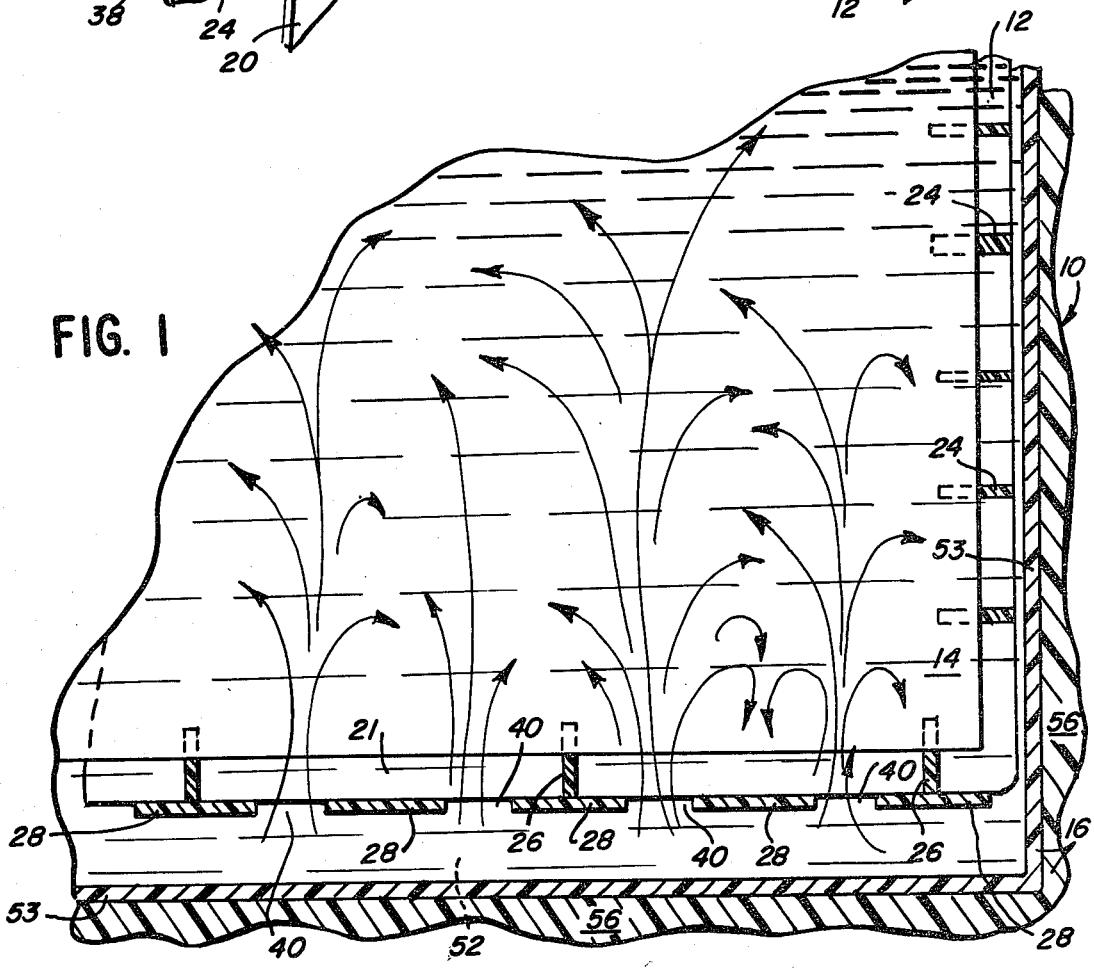
FIG. 1 is a fragmentary vertical section view showing a basket containing photographic sheets submerged in a tank with arrows illustrating the way in which the base plates create a turbulence and direct fluid flow.

The basket assembly and processing tank system 10, illustrated in FIGS. 1 and 8, are capable of developing one or more flexible exposed photographic sheets of material. A basket assembly 12 is used to secure and segregate each exposed sheet or pair of sheets of photographic material 14 so that each sheet 14 remains in the basket 12 and the sensitive surface of each sheet 14 does not contact the sensitive surface of the adjacent sheet or the structure of the basket 12 when it is submerged and agitated within a tank 16 containing processing fluids.

As shown principally in FIGS. 1 and 8, the basket assembly 12 comprises, a front member 20 and a back member 21 with handles 22, a plurality of side combs 24, a plurality of bottom combs 26, a plurality of base plates 28, a pair of movable top combs 30, a plurality of raised sloping guides 32, and a pair of clip latches 34. The substantially upright front and back members 20 and 21 define the front and back of the basket 12 and are held in spaced relationship with each other by the side combs 24 and bottom combs 26. In the preferred embodiment, the front and back members 20 and 21 are solid, it should be obvious to one of ordinary skill in the art that other forms of front and back members 20 and 21 may be used if consistent with the overall teachings of the invention. Both the front and back members 20 and 21 have a handle portion 22 and a pair of raised sloping guides 32. Both the handle portion 22 and the raised guide portion 32 may be affixed to or constructed as a unitary part with the front and back members 20 and 21. In the preferred embodiment the portions are unitary. Each handle 22 cantilevers upwardly from the front and back members 20 and 21. Each handle portion 22 has a hole 36 disposed vertical of the center of gravity of the basket 12 so that when the basket 12 is suspended from said holes 36, it hangs square. In this manner, a plurality of baskets 12 may be suspended from a rod for commercialized mass processing use with a plurality of tanks 16 or a single large tank designed for commercial use. Furthermore, as an alternative to the development process described hereinafter, by inserting the rod through said holes 36 and oscillating the rod up and down, each of the baskets 12 is agitated within a plurality of the tanks 16 in a manner similar to the up and down agitation of a single basket 12 in a single tank 16.

Figure 3:
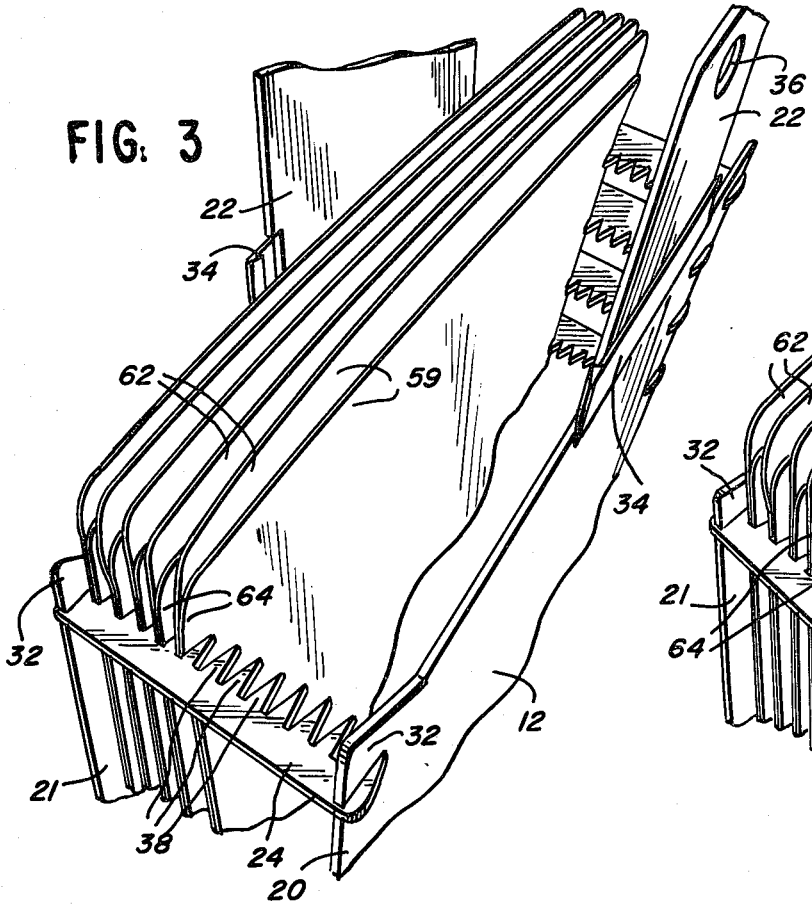
FIG. 3 is a fragmentary perspective view of the basket showing the pairs of guide cards disposed between the side combs.

The side combs 24 and the bottom combs 26 each have a plurality of individual teeth 38 disposed inwardly, as shown in FIG. 3. Each tooth 38 of one comb aligns with a corresponding tooth 38 from each other comb to define a vertical plane substantially parallel to the front and back members 20 and 21. Each tooth 38 has sufficient width to segregate the sensitive exposed sides of the photographic sheets 14 when they are held therebetween. In the preferred embodiment the side combs 24 and the bottom combs 26 are similarly constructed, however, other embodiments may be used. For example, the teeth 38 of the bottom combs 26 may be rounded or may have greater length than the teeth 38 of the side combs 24 thereby simplifying the proper placement of photographic sheets 14 along the bottom of basket 12.

As shown in FIG. 1, the base plates 28 are disposed along the bottom of the basket 12 in spaced relationship with each other. The photographic sheets 14 develop more uniformly and virtually free of imperfections when the base plates 28 are disposed parallel to each other defining a ratio of plate 28 surface area to opening 40 area of approximately three to two. This even development is attributable to the degree of fluid turbulence directed at the photographic sheets 14 and caused by the base plates 28 when the basket 12 is mildly agitated within the fluid 18. The arrows in FIG. 1 illustrate the direction of flow of the fluid 18 caused by the base plates 28 when the basket 12 is lowered into the tank 16. Although various bottom pieces may be used to create the desired fluid turbulence, the configuration of base plates 28 described above and illustrated in FIG. 1 is a preferred embodiment.

In FIG. 6, the movable top combs 30, the raised sloping guide portions 32, and the clip latches 34 in combination provide a simple means by which photographic sheets 14 are secured and segregated along their top edge. Each movable top comb 30, illustrated in FIG. 7, has a pair of guide arms 44 and a plurality of teeth 42 which coincide to the teeth 38 of side combs 24 and bottom combs 26. Each movable top comb tooth 42 aligns with a tooth 38 from each side comb 24 and each bottom comb 26 in the vertical planes defined by said teeth 38 when the guide arms 44 engage the raised sloping guide portions 32 or the top edge of front and back members 20 and 21, as shown in FIGS. 4–6. The raised sloping guides 32 jut upwardly from each upper corner of the front and back members 20 and 21 and slope downward towards the handle 22. The sliding engagement of the movable top combs 30 with the raised guides 32 segregate the photographic sheets or pair of sheets 14 and prevent the sensitive photo surfaces from touching each other. The clip latches 34 have detents 46 at each longitudinal end and are disposed near the outside base of both handles 22. The latches 34 are centrally affixed to each handle 22 such that a recoiling action is created when the movable top comb 30 pushes aside the detents 46. This recoiling action causes the latches 34 to capture the movable top comb 30 and secure it so that the photographic sheets 14 are held on all sides within the basket 12, as shown in FIG. 6. Many types of latching devices may be used, for example, a rubber band which surrounds the movable top combs 30 and handles 22 may be used, however, the clip latch 34 is a preferred embodiment because it requires very little effort by the user to securely latch the movable top comb 30 in the dark.

Figure 10:
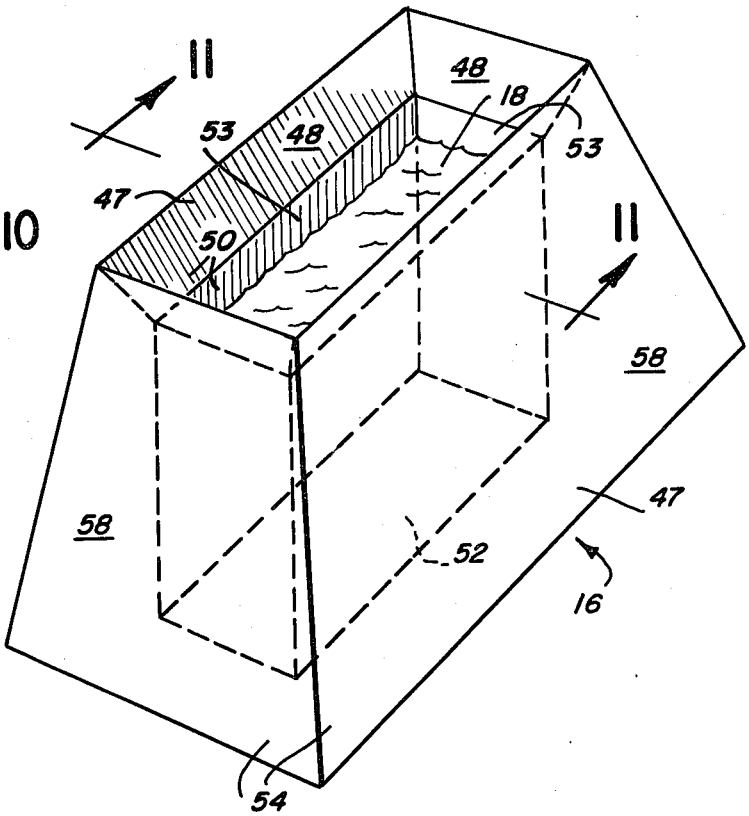
FIG. 10 is a perspective view of the tank showing the tip resistant sides and funnel-like guide ridge.
Figure 11:
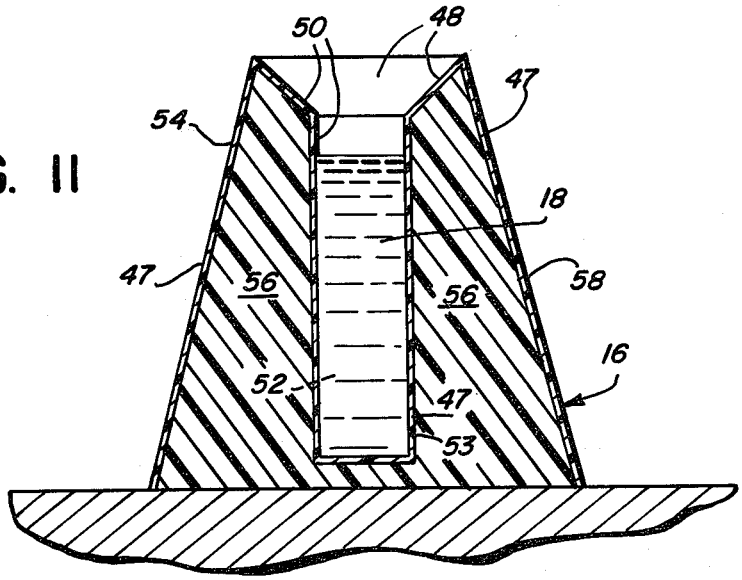
FIG. 11 is a transverse vertical section of the tank along line 11—11 of FIG. 10 showing the unitary tank shell construction and the solid material mold that prevents bowing of the inside walls of the tank.

As principally shown in FIGS. 8, 10, and 11, the processing tank 16 comprises an outer tank shell 47 and a solid mold form 56. The outer shell 47 comprises inner retaining walls 50 and outer retaining walls 54. The inner walls 50 are disposed between the outer walls 54 and the solid mold form 56 occupies the volume between the outer retaining walls 54 and the inner retaining walls 50. The upper portion of the inner walls 50 is a rectangular funnel-like guide ridge 48 that assists when a user inserts the basket assembly 12 into the lower portion 53 of the inner retaining walls 50. In addition, the ridge 48 operates as a retention collar preventing the overflow of displaced fluid 18 when the basket assembly 12 is lowered into the tank 16. The lower portion 53 of the inner retaining walls 50 defines a substantially rectangular open cavity 52 to hold processing fluids 18 and to receive the basket assembly 12. The outer retaining walls 54 are substantially trapezoidal sides 58 with their longer bases defining the base of the processing tank 16 which makes the tank 16 significantly more resistant to tipping than conventional rectangular tanks. A tank 16 may be constructed with rectangular longitudinal sides that is also resistant to tipping, however, the tank with trapezoidal sides is a preferred embodiment. The solid mold form 56 upon which the tank shell 47 rests prevents the inner retaining walls 50 from bowing under the pressure exerted by the fluid solution 18 and reinforces the tank 16 structure. Furthermore, in the preferred embodiment the mold form 56 is made from styrofoam which provides good insulation for the tank 16. Thus, if the processing fluid must be maintained within a temperature range, the solid mold form 56 is a uniform temperature.

In the preferred embodiment the basket assembly 12 and the tank shell 47 are constructed of a light-weight, inexpensive, and durable plastic material. Other materials may be used, but a plastic material is preferred because it may be molded and assembled and it does not absorb or contaminate the developing fluids 18.

The operation of the basket and tank assembly 10 is relatively simple, and after preparing the basket assembly 12 to receive photographic sheets 14 in a lighted room and filling the processing tank 16 with the appropriate fluid 18, all subsequent steps may be performed easily in a dark room. Prepping the basket 12 involves slidably inserting pairs of guide cards 59 into each notch 60 between the teeth 38 in the side combs 24 and the bottom combs 26, such that the guide cards 59 are held upright within the basket 12. As shown inf FIG. 3, each pair of guide cards 59 has a first card 62 longer than the second card 64. Each pair of guide cards 59 is inserted so that the first card 62 is always disposed on the same side with relation to the second card 64 as all other first cards 62. The guide cards 59 may be made of sturdy yet flexible material such as plastic or paperboard. Since the proper insertion of guide cards 59 would be a most difficult task to perform in the dark, this step is done in a lighted room so that the proper positioning of the guide cards 59 in aligning notches 60 is assured. Care should be taken to make certain that the guide cards 59 rest properly in the bottom combs 26. Alternative embodiments using rounded or longer teeth 38 for the bottom combs 26 may be used to facilitate the proper disposition of the guide cards 59. Another alternative embodiment which may be used to achieve positive disposition of the guide cards 59 is to use slotted blocks having grooves or channels corresponding to the notches 60 in each comb 24 and 26. The blocks would fit over the side portions of the basket assembly 12 such that the slots engaged the side combs 24 thereby forming continuous side channels down which the guide cards 59 could slidably be inserted. However, since this embodiment requires additional steps, i.e., inserting and removing the slotted blocks, it is not preferred.

Figure 2:
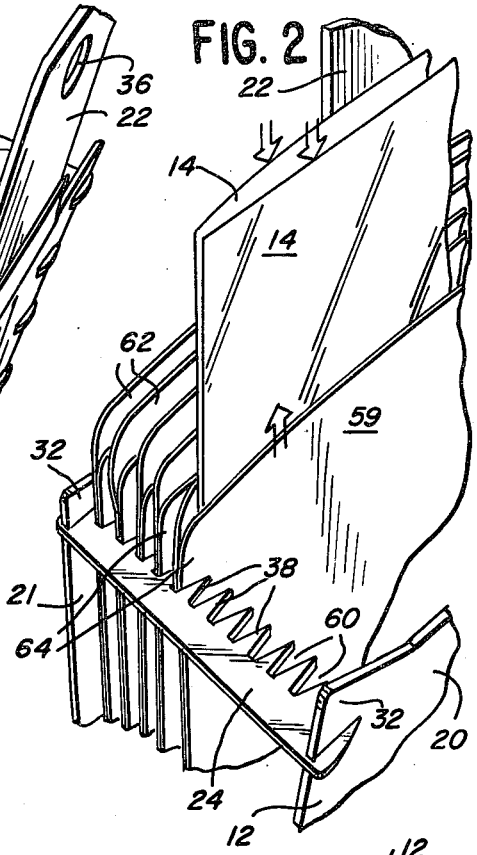
FIG. 2 is another fragmentary perspective view of the basket showing a pair of photographic sheets being inserted between the guide cards and into the basket.

All subsequent steps in operating the basket and tank assembly 10 until the photographic sheets 14 may be subjected to room light are performed in a dark room. Therefore, the person operating the assembly 10 is limited almost entirely to using his sense of touch. To load the exposed photographic sheets 14 into the basket 12, the user grasps the basket 12 and pulls back slightly the portion of a first card 62 that extends above its companion second card 64, thus creating a bent guide that properly routes the sheet 14 into the basket 12. If one sheet 14 is to be placed between each set of notches 60, the exposed side of each sheet 14 should be disposed facing the same direction to compensate for the natural curvature of the sheets 14. As illustrated in FIG. 2, however, a pair of sheets 14 may be inserted between each pair of guide cards 59 if the sheets 14 are placed back-to-back such that the exposed surfaces face in opposite directions, as shown in FIG. 2. The opposing natural curvatures of the sheets 14 will reduce the normal curvature thereby preventing the adjacent exposed faces from touching each other.

After each photographic sheet or pair of sheets 14 is inserted between the guide cards 59, the guide cards 59 are removed, leaving only the photographic sheets 14 segregated and resting within the basket 12.

To secure the photographic sheets 14 within the basket 12, the movable top combs 30 are latched to the basket 12. Referring to FIG. 4, each movable top comb 30 is first positioned such that its guide arms 44 engage the raised sloping guides 32, and then as shown in FIGS. 5 and 6 it is slidably moved along the top of the front and back members 20 and 21 until it engages the clip latch 34 in a snap-lock fashion. This segregates the exposed photographic sheets 14 in a manner corresponding with the segregation of the sheets 14 by the side combs 24 and the bottom combs 26, and secures the sheets 14 along their top edge so that they will not move appreciably during the submersion and agitation of the basket 12.

When the movable top combs 30 are securely latched in place, as shown in FIG. 6, the basket 12, assisted by the guide ridge 48 of tank 16, is submerged and vertically agitated within the processing fluid 18 contained in the tank 16. After extracting the basket 12, it may be submerged in another tank 16 containing another solution. This step is repeated for each operation in the processing sequence through the final washing. As illustrated in FIG. 9, after washing, the photographic sheets 14 are removed from the basket 12, as shown in FIG. 9, and left to dry.

While a particular embodiment of the invention has been shown, it is to be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A photographic processing basket for use in processing flexible exposed photographic sheet material comprising:

substantially rectangular front and back members;

a handle extending upwardly from the top of said front and back members for holding the basket during use;

a plurality of spacers mounted along three sides and between said front and back members for holding said front and back members in spaced parallel relationship with each other creating a box-like structure;

each of said spacers having a means for receiving and separating said flexible photographic sheet material;

a plurality of base plates mounted in spaced relationship with each other across one side of said box-like structure and subtending at least some of said spacers for directing fluid and for creating solution turbulence when the basket is agitated within processing fluids;

a movable comb for engaging the top side of said front and back members and for holding and separating said flexible photographic sheet material;

means for guiding said comb along the top of said front and back members; and, means for securely latching said comb to said front and back members thereby holding and separating the flexible photographic sheet material on all sides.

2. A basket as set forth in claim 1 wherein said basket further comprises a plurality of removable guide card pairs; each of said guide card pairs having one card of greater length than the other, said guide card pairs positioned by said spacers for receiving and guiding the flexible exposed photographic sheets into the basket.

3. A basket as set forth in claim 2 wherein said guiding means comprises a pair of raised sloping shoulders, each shoulder extending upwardly from each upper corner and along the top of said front and back members and having a top edge sloping downward towards said handle for slidably guiding said movable comb to engagement with said latching means.

4. A basket as set forth in claim 3 wherein said base plates are disposed equidistant from each other such that the ratio of plate surface area to bottom opening area along the bottom of the basket is approximately three to two.

5. A basket as set forth in claim 4 wherein said spacers have comb-like teeth extending inwardly toward the center of said front and back members for holding and separating exposed photographic material.

6. A basket as set forth in claim 5 wherein a tooth from each spacer aligns in a plane and said planes are in parallel spaced relationship with each other.

7. A basket as set forth in claim 5 wherein said latching means comprises a bar having detents at each longitudinal end, said bar being affixed centrally to the outside portion of each handle for capturing and securing said movable comb with a snap-lock action.

8. A basket as set forth in claim 7 wherein said movable comb includes guide arms for engaging said guide means.

9. A basket as set forth in claim 8 wherein each handle has a hole aligned horizontally with each other handle hole and with its center in the vertical plane projecting above the center of gravity of the basket such that the basket hangs square when suspended freely from said holes.

10. A photographic processing tank for retaining fluids and for use in processing photographic material comprising:

an outer shell having inner and outer retaining walls;

said outer retaining walls having substantially trapezoidal sides forming a wide base for said tank;

said inner retaining walls having a ridge for guiding said photographic material into said tank and for preventing spillage of displaced processing fluid;

said inner retaining walls further having a lower portion which defines a substantially rectangular cavity for holding processing fluids and for receiving said photographic material; and, a solid mold form filling the cavity between said inner and outer retaining walls for restricting bowing of said inner retaining walls due to pressure created by fluid within said rectangular cavity defined by said inner retaining walls.

11. An exposed photographic sheet material processing system for developing photographic sheets comprising:

a basket for securing the photographic sheets in spaced parallel relationship and for creating turbulence and directing fluid flow during processing;

said basket comprising:

substantially rectangular front and back members;

a handle extending upwardly from the top of said front and back members for holding the basket during use;

a plurality of spacers mounted along three sides and between said front and back members for holding said front and back members in spaced parallel relationship with each other creating a box-like structure;

each of said spacers having a means for receiving and separating said flexible photographic sheet material;

a plurality of base plates mounted in spaced relationship with each other across one side of said box-like structure and subtending at least some of said spacers for directing fluid and for creating solution turbulence when the basket is agitated within processing fluids;

a movable comb for engaging the top side of said front and back members and for holding and separating said flexible photographic sheet material;

means for guiding said comb along the top of said front and back members; and, means for securely latching said comb to said front and back members thereby holding and separating the flexible photographic sheet material on all sides; and a tank for retaining processing fluids and for receiving said basket; said tank having an outer shell comprising inner and outer retaining walls, and a solid mold form.

12. A processing system as set forth in claim 11 wherein said outer retaining walls further comprise substantially trapezoidal sides forming a wide base for said tank.

13. A processing system as set forth in claim 12 wherein said inner retaining walls of said outer shell include a lower portion which defines a substantially rectangular cavity for holding processing fluids and for receiving said basket.

14. A processing system as set forth in claim 13 wherein said solid mold form fills the cavity between said inner and outer retaining walls for restricting the bowing of the inner retaining walls when processing solutions are disposed within the cavity defined by said inner retaining walls.

15. A processing system as set forth in claim 14 wherein said inner retaining wall of said outer shell includes a ridge for guiding said basket into said tank and for preventing spillage of displaced fluid.

16. A processing system as set forth in claim 15 wherein said guide ridge is a substantially rectangular funnel.

17. A method for processing flexible photographic sheet materials held within a basket assembly by immersion into a tank containing processing fluids, which comprises the steps:

inserting at least one pair of guide cards within said basket assembly which holds and segregates said pair of guide cards;

inserting flexible photographic sheet materials between said cards of each pair of guide cards;

removing of said guide cards while leaving the photographic sheets secured in said basket;

engaging a movable comb for holding and segregating the top edge of the photographic sheets;

latching said movable comb in position for securely holding and segregating the photographic sheets on all sides; and, vertically agitating said basket containing the photographic sheets within the processing fluid filled tank.

18. A method for processing exposed photographic sheets as set forth in claim 16 wherein a pair of exposed photographic sheets disposed back-to-back are inserted between the cards of each pair of guide cards.

19. A method for processing exposed photographic sheets as set forth in claim 16 wherein a single sheet is inserted between the cards of each pair of guide cards and the exposed side of each sheet so inserted faces the same direction.

* * * * *